US009874046B2

(12) United States Patent
Wittelsbuerger et al.

(10) Patent No.: US 9,874,046 B2
(45) Date of Patent: Jan. 23, 2018

(54) MOTOR VEHICLE LOCK

(71) Applicant: Brose Schliesssysteme GmbH & Co. KG, Wuppertal (DE)

(72) Inventors: Michael Wittelsbuerger, Lake Orion, MI (US); David Rosales, Rochester Hills, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 663 days.

(21) Appl. No.: 13/941,254

(22) Filed: Jul. 12, 2013

(65) Prior Publication Data

US 2014/0284943 A1 Sep. 25, 2014

Related U.S. Application Data

(63) Continuation-in-part of application No. 13/929,258, filed on Jun. 27, 2013, now abandoned.

(Continued)

(51) Int. Cl.
*E05C 3/06* (2006.01)
*E05B 77/06* (2014.01)

(Continued)

(52) U.S. Cl.
CPC ..... *E05B 77/06* (2013.01); *E05B 85/243* (2013.01); *Y10S 292/22* (2013.01); *Y10T 292/0908* (2015.04)

(58) Field of Classification Search
CPC ..... Y10S 292/22

(Continued)

(56) References Cited

U.S. PATENT DOCUMENTS 703,962 A 7/1902 John et al.
846,129 A 3/1907 Clyde et al.

(Continued)

FOREIGN PATENT DOCUMENTS

DE 19511651 A1 * 10/1995 ..... E05B 77/06
DE 10337392 3/2005

(Continued)

OTHER PUBLICATIONS

German Search Report for DE 10 2014 104 111.9, dated Dec. 1, 2014 (7 pages).

(Continued)

*Primary Examiner* — Carlos Lugo
(74) *Attorney, Agent, or Firm* — Pauly, DeVries Smith & Deffner LLC

(57) ABSTRACT

The invention relates to a motor vehicle lock for a motor vehicle door arrangement, wherein a catch and a pawl are provided. The catch can be brought into an opening position and into a closed position. The catch may be brought into holding engagement with a lock striker. The pawl may be brought into an engagement position. The pawl may be deflected into a release position. A pawl actuation lever is provided for deflecting the pawl. An engagement arrangement is provided. The engagement arrangement comprises a deflection lever on the side of the pawl actuation lever and a counter contour on the side of the pawl. The deflection lever is configured to engage the counter contour. An actuation movement of the pawl actuation lever can deflect the pawl into the release. An inertial characteristic of the deflection lever causes a deflection movement along a free-wheeling path.

17 Claims, 6 Drawing Sheets

Related U.S. Application Data

(60) Provisional application No. 61/804,918, filed on Mar. 25, 2013.

(51) Int. Cl.
*E05B 85/24* (2014.01)
*E05C 3/16* (2006.01)

(58) Field of Classification Search
USPC ..... 292/216
See application file for complete search history.

(56) References Cited

U.S. PATENT DOCUMENTS

| | | | | |
|---|---|---|---|---|
| 2,793,898 | A | 5/1957 | Roethel et al. | |
| 2,832,626 | A | 4/1958 | Priestman et al. | |
| 3,848,909 | A | 11/1974 | Foley et al. | |
| 4,911,489 | A | 3/1990 | Hansen et al. | |
| 5,183,300 | A | 2/1993 | Schrader et al. | |
| 5,865,481 | A * | 2/1999 | Buschmann | E05B 77/06 292/169.11 |
| 6,308,998 | B1 | 10/2001 | Armbruster et al. | |
| 6,471,259 | B1 | 10/2002 | Erices et al. | |
| 6,543,820 | B2 | 4/2003 | Kelly et al. | |
| 6,971,688 | B2 | 12/2005 | Drysdale et al. | |
| 7,198,307 | B2 | 4/2007 | Drysdale et al. | |
| 7,325,874 | B2 | 2/2008 | Zhang et al. | |
| 7,607,702 | B2 * | 10/2009 | Pereverzev | E05B 77/06 292/201 |
| 7,703,828 | B2 | 4/2010 | O'connor et al. | |
| 7,926,858 | B2 | 4/2011 | Otsuka | |
| 8,056,944 | B2 * | 11/2011 | Jankowski | E05B 77/06 292/201 |
| 8,303,004 | B2 | 11/2012 | Lee et al. | |
| 8,727,443 | B2 | 5/2014 | Vedder et al. | |
| 8,764,077 | B2 | 7/2014 | Takagi et al. | |
| 9,109,380 | B2 | 8/2015 | Mittelbach et al. | |
| 9,366,063 | B2 | 6/2016 | Rosales et al. | |
| 9,732,544 | B2 | 8/2017 | Wittelsbuerger et al. | |
| 2009/0322105 | A1 | 12/2009 | Lee et al. | |
| 2010/0237633 | A1 | 9/2010 | Jankowski et al. | |
| 2010/0283268 | A1 | 11/2010 | Cumbo | |
| 2011/0084505 | A1 | 4/2011 | Brose et al. | |
| 2011/0181052 | A1 | 7/2011 | Brose et al. | |
| 2011/0254343 | A1 | 10/2011 | Vedder et al. | |
| 2013/0129413 | A1 | 5/2013 | Dryburgh et al. | |
| 2013/0147209 | A1 | 6/2013 | Lee et al. | |
| 2013/0147211 | A1 | 6/2013 | Lee et al. | |
| 2013/0313036 | A1 | 11/2013 | Kovie | |
| 2013/0328325 | A1 | 12/2013 | Uehara et al. | |
| 2014/0097624 | A1 | 4/2014 | Papanikolaou et al. | |
| 2014/0132008 | A1 | 5/2014 | Bendel et al. | |
| 2014/0284939 | A1 | 9/2014 | Wittelsbuerfer et al. | |
| 2014/0284942 | A1 | 9/2014 | Wittelsbuerger et al. | |
| 2014/0284944 | A1 | 9/2014 | Rosales et al. | |
| 2014/0346786 | A1 | 11/2014 | Takagi et al. | |
| 2015/0061301 | A1 | 3/2015 | Torka et al. | |
| 2015/0115628 | A1 | 4/2015 | Wittelsbuerger et al. | |
| 2016/0090759 | A1 | 3/2016 | Rosales et al. | |

FOREIGN PATENT DOCUMENTS

| | | |
|---|---|---|
| DE | 102004014550 | 10/2005 |
| DE | 202009009060 | 1/2011 |
| DE | 202009009061 | 1/2011 |
| EP | 1018589 | 7/2000 |
| EP | 1518983 | 3/2005 |
| WO | 2012055387 | 5/2012 |
| WO | 2012119580 | 9/2012 |

OTHER PUBLICATIONS

Non-Final Office Action for U.S. Appl. No. 13/929,258, dated Mar. 27, 2015 (17 pages).
Non-Final Office Action for U.S. Appl. No. 13/929,278, dated Mar. 31, 2015 (22 pages).
Search Report for German Patent Application No. 102014104188.6 related to U.S. Appl. No. 13/929,258, dated Dec. 9, 2014 (7 pages).
Final Office Action for U.S. Appl. No. 13/929,258 dated Nov. 27, 2015 (14 pages).
Non Final Office Action for U.S. Appl. No. 14/065,124, dated Feb. 19, 2016 (10 pages).
Final Office Action for U.S. Appl. No. 14/871,601 dated Oct. 11, 2016 (18 pages).
Non-Final Office Action for U.S. Appl. No. 14/871,601, dated May 20, 2016 (20 pages).
Final Office Action for U.S. Appl. No. 14/065,124 dated Sep. 29, 2016 (10 pages).
Amendment and Response to Non-Final Office Action dated Feb. 19, 2016, for U.S. Appl. No. 14/065,124 submitted via EFS—Web on Jul. 19, 2016, 9 pages.
Amendment and Response to Non-Final Office Action, dated Mar. 31, 2015 for U.S. Appl. No. 13/929,278, submitted via EFS—Web on Jul. 31, 2015, 10 pages.
Non-Final Office Action for U.S. Appl. No. 14/871,601 dated Apr. 21, 2017 (12 pages).
Notice of Allowance for U.S. Appl. No. 13/929,193 dated Jun. 30, 2017 (15 pages).
Final Office Action for U.S. Appl. No. 13/929,193 dated Aug. 23, 2016 (14 pages).
Final Office Action for U.S. Appl. No. 13/929,193, dated Jun. 18, 2015 (16 pages).
German Search Report for DE application No. 102014104120.8 dated Mar. 13, 2015 (5 pages).
Non Final Office Action for U.S. Appl. No. 13/929,193 dated Oct. 23, 2014 (18 pages).
Non-Final Office Action for U.S. Appl. No. 13/929,193 dated Jan. 20, 2016 (17 pages).
Non-Final Office Action for U.S. Appl. No. 13/929,193 dated Jan. 3, 2017 (17 pages).
Response to Non-Final Office Action for U.S. Appl. No. 13/929,193, filed Mar. 23, 2015 (8 pages).

* cited by examiner

MOTOR VEHICLE LOCK

CLAIM OF PRIORITY

This application is a continuation-in-part of U.S. application Ser. No. 13/929,258, filed Jun. 27, 2013, which claims the benefit of U.S. Provisional Application No. 61/804,918, filed Mar. 25, 2013, the contents of which are herein incorporated by reference.

FIELD OF THE INVENTION

The invention is directed to a motor vehicle lock for a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

Crash safety plays an important role for today's motor vehicle locks. It is in particular important that neither crash induced acceleration nor crash induced deformation leads to an accidental and unintended opening of the motor vehicle door which the motor vehicle lock is assigned to. The focus of the present application is to prevent an unintended opening of the motor vehicle door based on crash induced acceleration. In case of an impact, in particular a side impact, the motor vehicle, including the motor vehicle door, is subjected to a very high acceleration. Because the outer door handle comprises an inertial mass which is not rigidly connected to the vehicle door, the outer door handle does not immediately follow the movement of the motor vehicle door which is due to the acceleration stemming from the impact. As a result, a relative movement between the outer door handle and the motor vehicle door is caused, which may correspond to an opening movement of the outer door handle and thereby lead to an unintended opening of the motor vehicle door.

The known motor vehicle lock (US 2011/0181052 A1), which is the starting point for the present invention, is provided with the usual lock elements catch and pawl, wherein the pawl may be deflected into a release position by actuation of a pawl actuation lever.

The known motor vehicle lock also comprises a lock mechanism which may be brought into different functional states such as "unlocked" and "locked" by the user. The pawl may be deflected into its release position by an outer door handle which is connected to the pawl actuation lever if the lock mechanism is in its unlocked state. With the lock mechanism being in its locked state, an actuation of the pawl actuation lever runs free.

To guarantee a high crash safety the known motor vehicle lock comprises a crash element which is a separate component from the pawl actuation lever. By the accelerations which occur during a crash, the crash element moves into a blocking position in which the crash element blocks further actuation of the pawl actuation lever.

One disadvantage of the known motor vehicle lock is the fact that, before the intended blocking of the pawl actuation lever takes place, the crash element has to perform the above noted movement into the blocking position. The necessity of the movement of the crash element before the intended blocking takes place leads to undesirable reaction times of the crash safety function.

Furthermore for the known motor vehicle lock, the constructional design of the drive train between the door handle and the pawl appears to be challenging. This is true as in a crash situation not only the pawl actuation lever, but in fact the whole drive train starting from the door handle to the pawl actuation lever is being locked. In order not to run the risk of an unpredictable breakage of some component in this drive train, i.e. even some component other than the pawl actuation lever, it has to be designed for exceptionally high forces, which in turn leads to high material and production costs.

SUMMARY

It is the object of the invention to improve the known motor vehicle lock such that a cost effective constructional design is possible without reducing the resulting crash safety.

The above noted object is solved for a motor vehicle lock according to a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein a pawl actuation lever is provided for deflecting the pawl into the release position, wherein an engagement arrangement is provided between the pawl actuation lever and the pawl, wherein the engagement arrangement comprises a deflection lever on the side of the pawl actuation lever and a counter contour on the side of the pawl, wherein the deflection lever is configured to engage the counter contour, thereby deflecting the pawl into the release position, wherein an actuation movement of the pawl actuation lever for deflecting the pawl into the release position is translated into a deflection movement of the deflection lever, wherein an inertial characteristic of the deflection lever causes a deflection movement along a free-wheeling path, in which free-wheeling path the deflection lever misses the counter contour, when the actuation movement surpasses a rapidity threshold, and causes a deflection movement along an engagement path, in which engagement path the deflection lever engages the counter contour, when the actuation movement is below the rapidity threshold An important recognition underlying the present invention is that it is better to nudge a moving component into a free-wheeling path in the case of a crash rather than to block a moving component in the case of a crash. This is because, as was already pointed out, in the case of the crash the door handle may experience a very fast relative movement to the vehicle door, thereby causing a very high velocity of the moving component which in turn may cause that moving component or some other part involved to break when it is being blocked. If, on the other hand, the moving component is on a free-wheeling path in case of a crash, there is no impact associated with such a blocking. Conversely, in the absence of a crash, i.e. during normal operation of the door handle, that moving component remains on an engagement path, thereby engaging the respective counterpart.

The invention is further based on the realization that a deflection lever used to deflect the pawl into a release position by engaging it when the door handle is actuated, is just such a component that could be set free-wheeling on a crash to achieve the desired crash safety behavior.

A distinction between the crash situation and a normal operating situation of the door handle may then be made based on the level of acceleration or speed with which the door handle—and as a result, the pawl actuation lever—is moved. Very high velocity or acceleration of the pawl actuation lever is indicative of a crash state. Therefore the inertial properties of the deflection lever, which is then either set on an engaging path or on a free-wheeling path, may be exploited. That is, the inertial properties of the deflection lever may be chosen such that in cases of high acceleration or velocity a free-wheeling movement is performed, whereas in the cases of lower acceleration or velocity a normal, an engaging movement of the deflection lever occurs.

This approach has the further benefit of obviating the need for a separate blocking component. Such a separate blocking component is undesirable because it is only used in the crash state, according to the prior art solution, and therefore serves no purpose in the normal operation state. By using the same component, i.e. the deflection lever, which is also used irrespective of crash safety, either on a free-wheeling or an engagement path, there is no need for a separate component. Thus, all components that are used in a normal operation mode suffice to implement the crash safety mode according to the invention. In other words, a component that was already present and used for the transmission of force from the door handle to the pawl may be arranged and configured such that a different behavior for different levels of velocity or acceleration, in particular different movement paths, result.

Thereby this approach provides an economical solution which omits extraneous components and avoids a risk of breakage caused by absorption of high velocity impacts.

An embodiment proposes using a circular motion of the deflection lever to exploit the centrifugal force, which is dependent on acceleration. In this way, a force in a direction perpendicular to the direction of movement which is proportional to the acceleration may be implemented by making use of this physical phenomenon.

Moreover, as suggested in an embodiment, the inertial mass of the deflection lever may be adjusted to achieve a particular sensitivity for the crash case.

Another kind of component which may be advantageously used to achieve different movement paths, depending on velocity or acceleration, is a spring. An embodiment suggests using a pre-tension spring that pre-stresses the deflection lever towards the engagement path. Depending on how fast the deflection lever traverses the distance to the engagement position, such a spring either has sufficient time to deflect the deflection lever toward the engagement path or not. Such an engagement spring may also be configured such that the force acting in the engagement direction actually increases as the deflection lever moves.

A preferred way in which different deflection movements for the deflection lever may be realized, particularly when making use of the centrifugal force, and to having the deflection lever be pivotable around an axis and by further having the deflection lever's center of mass be displaced from that axis.

In addition or as an alternative to the aforementioned pre-tension in the engagement direction, there may also be a spring arrangement exerting a pre-tension towards the free-wheeling path. This free-wheeling spring is configured to reduce the force it exerted towards the free-wheeling path as the deflection lever traverses along its movement path, thereby ensuring a greater tendency towards the free-wheeling path the faster the deflection lever moves.

The use of this free-wheeling spring, which is preferably also leg spring, either by itself or in combination with the aforementioned engagement spring, provides great flexibility for achieving a desired crash safety behavior of the deflection lever.

Further, a preferred embodiment suggests making use of the aforementioned mechanism to implement different functional states of the lock such as "unlocked" and "locked". For example, in such a "locked" state, in order to prevent deflection of the pawl into the release position, some mechanical structure may be used to force the deflection lever into the free-wheeling path, thereby replicating the crash situation. This implementation of different functionalities by reusing components reduces overall system complexity and costs.

In an embodiment, the invention provides a motor vehicle lock for a motor vehicle door arrangement, wherein a catch and a pawl, which is assigned to the catch, are provided, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch, wherein a pawl actuation lever is provided for deflecting the pawl into the release position, wherein an engagement arrangement is provided between the pawl actuation lever and the pawl, wherein the engagement arrangement comprises a deflection lever on the side of the pawl actuation lever and a counter contour on the side of the pawl, wherein the deflection lever is configured to engage the counter contour, thereby deflecting the pawl into the release position, wherein an actuation movement of the pawl actuation lever for deflecting the pawl into the release position is translated into a deflection movement of the deflection lever, wherein an inertial characteristic of the deflection lever causes a deflection movement along a free-wheeling path, in which free-wheeling path the deflection lever misses the counter contour, when the actuation movement surpasses a rapidity threshold, and causes a deflection movement along an engagement path, in which engagement path the deflection lever engages the counter contour, when the actuation movement is below the rapidity threshold.

In one embodiment, the counter contour is arranged on a contour plate which is coupled torque-proof to the pawl and/or wherein the deflection lever comprises a corner profile for engaging the counter contour.

In one embodiment, the deflection movement comprises a circular movement and the deflection movement along the free-wheeling path is caused by a centrifugal force acting on the deflection lever.

In one embodiment, the inertial characteristic of the deflection lever comprises the inertial mass and/or the center of mass, which inertial characteristic is configured such that it causes a deflection movement along the free-wheeling path through the centrifugal force acting on the deflection lever when the actuation movement surpasses a predetermined rapidity threshold.

In one embodiment, an engagement pre-tension force towards the engagement path is exerted on the deflection lever.

In one embodiment, the engagement spring is arranged such that the engagement pre-tension force increases with the deflection movement of the deflection lever.

In one embodiment, the deflection lever is configured to pivot around a pivoting axis and the center of mass of the deflection lever is displaced from the pivoting axis.

In one embodiment, the pivoting axis is a deflection lever axis of the pawl actuation lever.

In one embodiment, the engagement arrangement comprises a return spring arrangement configured to exert a return force on the pawl actuation lever.

In one embodiment, the return spring arrangement comprises a return spring which is a leg spring arranged around the actuation lever axis.

In one embodiment, a free-wheeling pre-tension force towards the free-wheeling path is exerted on the deflection lever.

In one embodiment, the deflection lever is coupled to a peg structure and that the free-wheeling spring arrangement comprises a free-wheeling spring which is configured to engage the peg structure to exert the free-wheeling pre-tension force.

In one embodiment, the free-wheeling spring is a leg spring and that relative movement between the free-wheeling spring and the peg structure causes a contact point between the peg structure and a leg of the free-wheeling spring to move up the leg, thereby reducing the free-wheeling pre-tension force.

In one embodiment, the deflection movement of the deflection lever causes a disengagement of the free-wheeling spring from the peg structure after the deflection movement has reached a disengagement distance.

In one embodiment, a lock mechanism is provided, which may be brought into different functional states such as "unlocked" and "locked" via a lock actuation arrangement and wherein the lock mechanism acts on the deflection lever for realizing the functional states "unlocked" and "locked" such that in the functional state "unlocked" the lock mechanism causes a deflection movement along the free-wheeling path and in the functional state "locked" the lock mechanism causes a deflection movement along the engagement path.

In one embodiment, the engagement pre-tension force towards the engagement path is exerted by an engagement spring arrangement.

In one embodiment, the engagement spring arrangement comprises an engagement spring.

In one embodiment, the pawl actuation lever is configured to pivot around an actuation lever axis and the deflection lever is pivotably coupled to the pawl actuation lever, in particular, wherein the engagement spring exerts the engagement pre-tension force on the actuation lever axis.

In one embodiment, the engagement spring is a leg spring arranged around the deflection lever axis.

In one embodiment, the return spring arrangement is configured to exert a return force on the pawl actuation lever on a return protrusion of the pawl actuation lever, in a direction opposite to the deflection movement.

In one embodiment, the free-wheeling pre-tension force towards the free-wheeling path is exerted by a free-wheeling spring arrangement.

In one embodiment, the deflection movement of the deflection lever causes a relative movement between the free-wheeling spring and the peg structure.

In one embodiment, the engagement arrangement comprises a blocking projection configured to disengage the free-wheeling spring from the peg structure after the deflection movement has reached the disengagement distance.

In one embodiment, a locking lever of the lock mechanism engages a lock contour of the deflection lever for causing a deflection movement along the free-wheeling path, in particular, wherein the lock contour is arranged at a same end of the deflection lever as the corner profile.

In certain embodiments the engagement arrangement comprises a flection structure with a pair of arms comprising a first arm and a second arm, wherein the pair of arms is coupled pivotably around a flection axis and wherein the flection structure is configured to exert an internal torque on the pair of arms against a pivoting of the pair of arms from an angled neutral position in at least one pivoting direction

BRIEF DESCRIPTION OF THE FIGURES

In the following, the invention will be described in an example referring to the drawings. In the drawings there is shown in FIG. 1 the relevant parts of a proposed motor vehicle lock when a pawl actuation lever is not actuated, FIG. 2 the proposed motor vehicle lock of FIG. 1 after the pawl actuation lever has been actuated and the deflection lever has moved along a free-wheeling path and FIG. 3 the proposed motor vehicle lock of FIG. 1 after the pawl actuation lever has been actuated and the deflection lever has moved on an engagement path.

DETAILED DESCRIPTION

Figure 1:
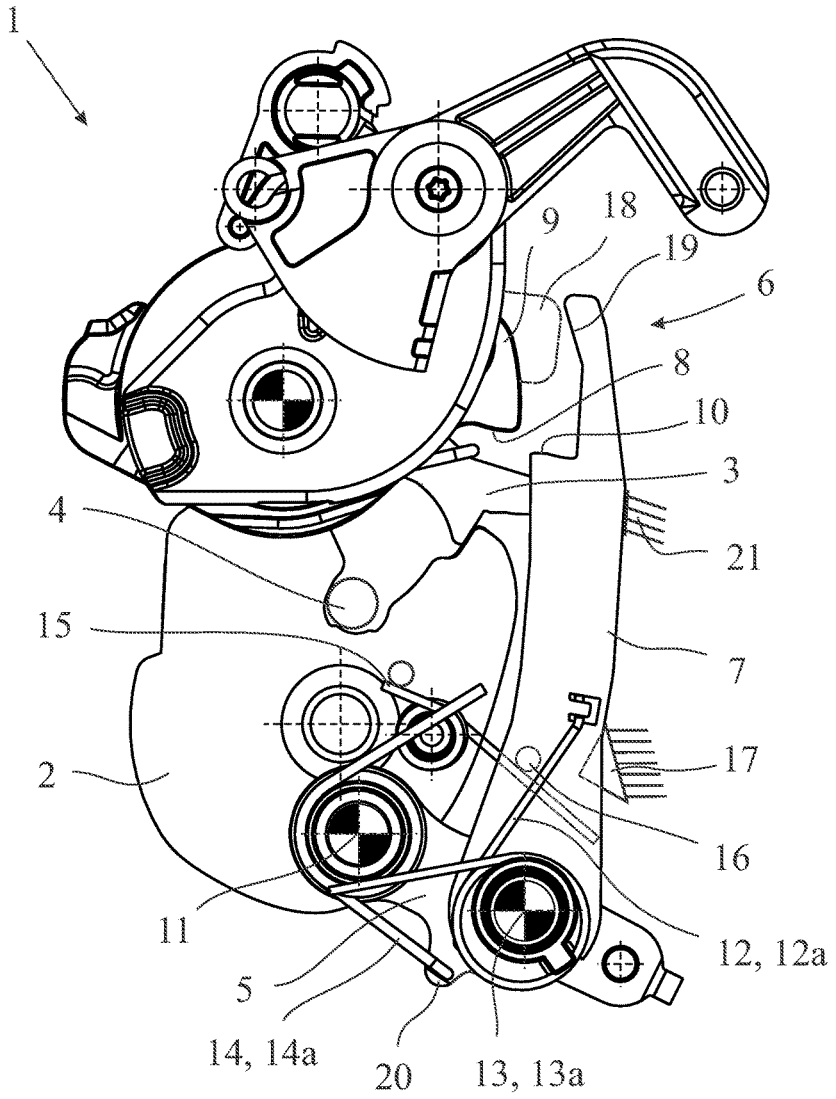

The motor vehicle lock 1 shown in the drawing is assigned to a motor vehicle door arrangement which comprises a motor vehicle door (not shown) beside said motor vehicle lock 1. Regarding the broad interpretation of the expression "motor vehicle door", reference is made to the introductory part of the specification. Here the motor vehicle door is a side door of the motor vehicle, which is also the preferred situation.

The motor vehicle lock 1 comprises the usual locking elements catch 2 and pawl 3, which pawl 3 is assigned to the catch 2. The catch 2 can be brought into an open position (not shown) and into a closed position. In the closed position shown in particular in FIG. 1, the catch 2 is or may be brought into holding engagement with a lock striker 4, which is shown in FIG. 1 as well. The motor vehicle lock 1 is normally arranged at or in the motor vehicle door, but the lock striker 4 is usually arranged at the motor vehicle body.

Figure 3:
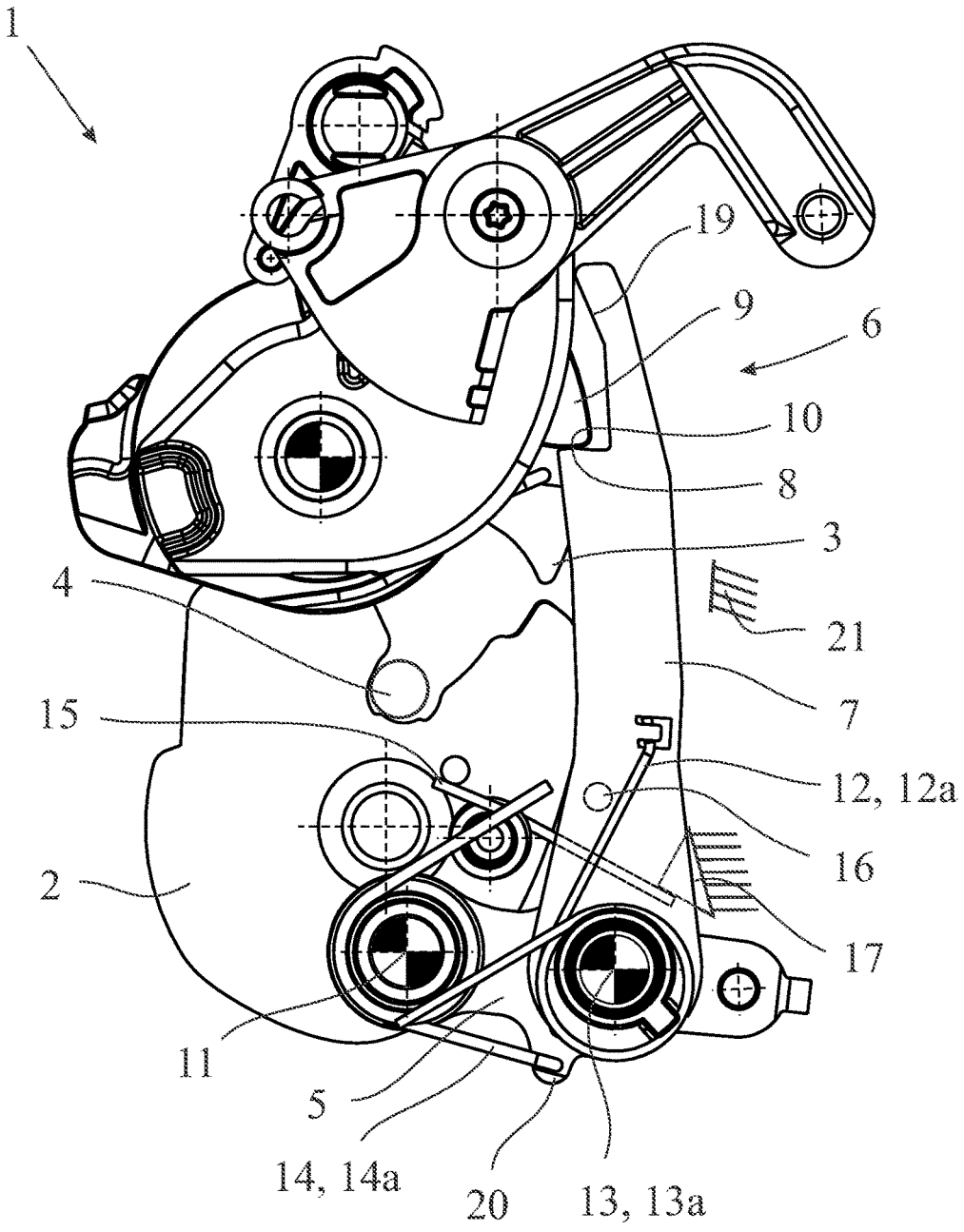

The pawl 3 may be brought into an engagement position, shown in FIG. 1, in which it is in blocking engagement with the catch 2. In the depicted embodiment, the pawl 3 blocks the catch 2 in its closed position in a mechanically stable manner such that the pawl 3 itself does not have to be blocked, which is also the preferred case. For release of the catch 2 into its open position, the pawl 3 may be deflected into a release position, which is shown in FIG. 3, and which release position would correspond to a deflection in the anti-clockwise direction starting from FIG. 1.

FIG. 1 also discloses a pawl actuation lever 5 that is provided for deflecting the pawl 3 into the release position.

The pawl actuation lever 5 may be coupled to a door handle, preferably to an outer door handle, such that the assigned motor vehicle door may be opened by actuating the door handle, thereby actuating also the pawl actuation lever 5. The preferred apparatus for coupling the outer door handle to the pawl actuation lever is a Bowden cable.

FIG. 1 also shows that an engagement arrangement 6 is provided between the pawl actuation lever 5 and the pawl 3, wherein the engagement arrangement 6 comprises a deflection lever 7 on the side of the pawl actuation lever 5 and a counter contour 8 on the side of the pawl 3. The deflection lever 7 is configured to engage the counter contour 8, thereby deflecting the pawl 3 into the release position. Such an engagement of the counter contour 8 by the deflection lever 7 with the resulting pawl 3 in the released position is shown in FIG. 3. It is to be noted that the deflection lever 7 does not need to be a lever in the strict sense, it may be any structure configured to engage a counter contour 8 and thereby deflect the pawl 3 into the release position.

The phrase "on the side of" is used above to describe the relative positions of the deflection lever 7 and the counter contour 8 within the engagement arrangement 6, with respect to the pawl actuation lever 5 and the pawl 3. As described above, the deflection lever 7 and the pawl actuation lever 5 are on the same side of the engagement arrangement 6. Actuating the pawl actuation lever 5 causes a movement of the deflection lever 7. The movement may occur either through a direct coupling between the pawl actuation lever 5 and the deflection lever 7 or it may involve any number of intermediate parts for translating this movement.

The counter contour 8 and the pawl 3 are on the same side of the engagement arrangement 6 as described above, though different than the side of the deflection lever 7. The counter contour 8 causes the pawl 3 to deflect when the deflection lever 7 engages the counter contour 8. The coupling between the counter contour 8 and the pawl 3 can be provided with a contour plate 9 as described below. In this example the contour plate 9 is next to and rotationally fixed to the pawl 3. Other options are also available for transferring movement of the counter contour 8 to the pawl 3. For example, the counter contour 8 can be provided directly on the pawl 3, or the contour plate 9 and the pawl 3 can be formed as an integral part.

Further an actuation movement of the pawl actuation lever 5 for deflecting the pawl 3 into the released position is translated into a deflection movement of the deflection lever 7.

In other words, actuating the pawl actuation lever 5 causes a movement of the deflection lever 7, which movement is called a deflection movement and which is, in principle, liable to move the deflection lever 7 such that it engages the counter contour 8 and thereby deflects the pawl 3 into the release position. This translation of the movement of the pawl actuation lever 5 into the deflection movement of the deflection lever 7 may occur either through a direct coupling between the pawl actuation lever 5 and the deflection lever 7 or it may involve any number of intermediate parts for translating this movement.

It can be seen from FIG. 1 that an actuation movement of the pawl actuation lever 5 corresponds to a rotation of the pawl actuation lever 5 in a counter clockwise direction and translates into a deflection movement of the deflection lever 7 in the same direction. Here and as is preferred, the deflection movement of the deflection lever 7 may be any rotational movement, translational movement or combination thereof.

The proposed motor vehicle lock 1 is now characterized in that an inertial characteristic of the deflection lever 7 causes a deflection movement along a free-wheeling path, in which free-wheeling path the deflection lever 7 misses the counter contour 8, when the actuation movement surpasses a rapidity threshold. A completed deflection movement along the free-wheeling path is shown in FIG. 2.

The proposed motor vehicle lock 1 is further characterized in that the inertial characteristic of the deflection lever 7 causes a deflection movement along an engagement path, in which engagement path the deflection lever 7 engages the counter contour 8 when the actuation movement is below the rapidity threshold. A completed deflection movement along the engagement path is shown in FIG. 3.

In this context, an inertial characteristic may refer to the inertial mass of the deflection lever 7, the moment of inertia of the deflection lever 7 or to both quantities. It may also, in addition or alternatively, refer to the center of mass of the deflection lever 7. Likewise, the rapidity threshold may be defined in terms of the speed or velocity of the actuation movement, in terms of the acceleration of the actuation movement or may in fact involve both quantities. It is also to be noted that there exists, in principle, more than one free-wheeling path and more than one engagement path. To the contrary, any path of a deflection movement which results in the deflection lever 7 missing the counter contour 8 is by definition a free-wheeling path, whereas any path of a deflection movement which results in the deflection lever 7 engaging the counter contour 8 is by definition an engagement path.

Figure 2:
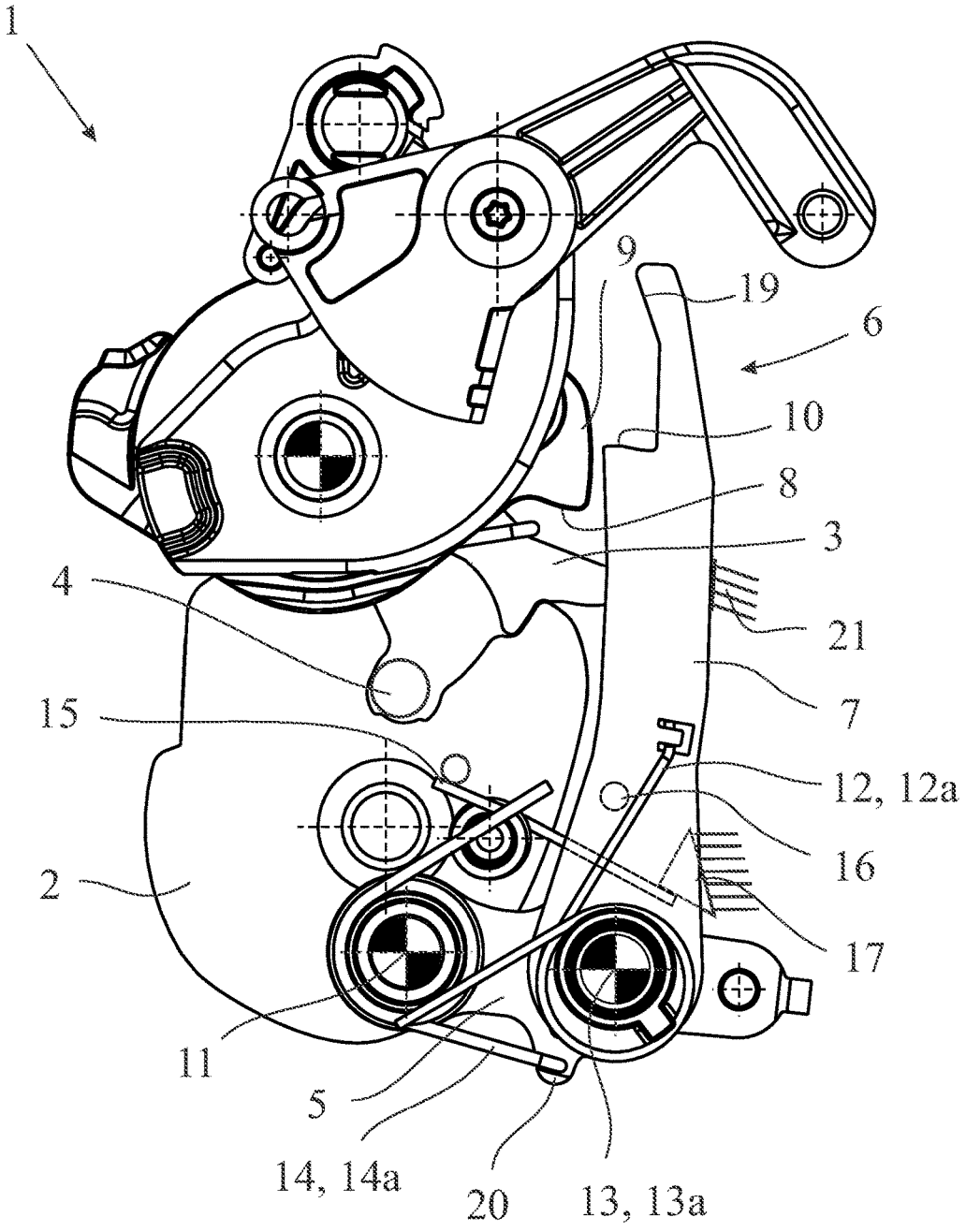

As mentioned, FIG. 2 now shows the deflection lever 7 having completed a deflection movement along a free-wheeling path. As can be seen, the deflection lever 7 has moved towards the counter contour 8 but has missed the counter contour 8 and thereby has not engaged the counter contour 8. The result is that the pawl 3 is not deflected.

As also mentioned, FIG. 3 shows the deflection lever 7 having completed a deflection movement along the engagement path with the result that the deflection lever 7 has engaged the counter contour 8, thereby deflecting the pawl 3 and having the catch 2 being released from the pawl 3. In other words, depending on how fast the actuation movement of the pawl actuation lever 5 occurs in terms of either speed, velocity and/or acceleration, the deflection lever 7 either engages a counter contour 8 or not. In particular, great speeds, velocities or accelerations of the actuation movement result in a free-wheeling path of the deflection movement and thereby prevent engagement. It is to be pointed out that because of the translation of the actuation movement of the pawl actuation lever 5 into the deflection movement of the deflection lever 7, any actuation movement with great speed, velocity or acceleration translates into a deflection movement of the deflection lever with proportional, if not identical, properties. This correspondence also holds when the actuation movement of the pawl actuation lever exhibits small speed, velocity or acceleration.

As shown in the drawings and as is also preferred, the counter contour 8 is arranged on a contour plate 9 which is coupled torque-proof to the pawl 3. Alternatively or in addition, the deflection lever 7 comprises a corner profile 10 for engaging the counter contour 8.

It is also preferred that the deflection movement comprises a circular movement and the deflection movement along the free-wheeling path is caused by a centrifugal force acting on the deflection lever 7. It can be seen from the drawings that the deflection movement of the deflection lever 7 is at least partially defined by a circular movement around the actuation lever axis 11. For such a circular movement, the centrifugal force acting on the deflection lever acts to move the deflection lever 7 away from the counter contour 8. Thereby the centrifugal force acts to force the deflection lever 7 towards a free-wheeling path in cases of high rapidity—as defined previously—and less so in cases of lower rapidity.

A deflection lever guide 21 may be provided to define a maximum displacement of the deflection lever 7 for the free-wheeling path. In addition or alternatively, an engagement lever guide (not shown) may be provided for limiting the displacement of the deflection lever 7 for the engagement path. Typically, the deflection lever guide 21 and the engagement lever guide are arranged on a casing, e.g. of the motor vehicle lock, around the deflection lever 7. Alternatively, either the deflection lever guide 21, or the engagement lever guide or both may be arranged on the pawl actuation lever 5, thereby providing an implementation that relies less on a fitting of tolerances.

To achieve predefined behaviors at different speeds or accelerations, i.e. to engage the counter contour 8 below a certain threshold and to move along the free-wheeling path beyond the threshold, it is preferred that the inertial characteristic of the deflection lever 7 comprises the inertial mass and in addition, or alternatively, the center of mass. This inertial characteristic is configured such that is causes a deflection movement along the free-wheeling path through the centrifugal force acting on the deflection lever 7 when the actuation movement surpasses a predetermined rapidity threshold.

Since it is a solid object, the deflection lever 7 has by necessity an intrinsic inertial mass and a center of mass. Both the inertial mass and the center of mass may be set to achieve the desired behavior with regard to the deflection movement path taken.

The inertial mass and the center of gravity may, for example, be either set during production of the deflection lever 7, for example by choosing its dimensions and the material used, or it may also be adjusted by adding further components that add to its inertial mass. Thereby the desired behavior with relation to the predetermined rapidity threshold may be achieved.

It may be advantageous to predispose the deflection lever 7 towards the engagement path. To that end, it is preferred that an engagement pre-tension force towards the engagement path is exerted on the deflection lever 7. This may preferably be implemented by having the engagement pre-tension force towards the engagement path be exerted by an engagement spring arrangement 12. In particular, this engagement spring arrangement 12 may comprise an engagement spring 12*a*. In this way the deflection lever 7 may be predisposed to move towards the counter contour 8, since that is the desired state in the absence of a crash state.

This engagement spring 12*a* may be arranged such that the engagement pre-tension force increases with the deflection movement of the deflection lever 7. In other words, the engagement pre-tension force becomes larger the further the deflection lever 7 moves during its deflection movement. This is evident from the arrangement of the engagement spring 12*a*, which is disclosed in FIGS. 1 to 3. As the deflection lever 7 moves towards the counter contour 8, the spring tension in the engagement spring 12*a* increases. Therefore also the engagement pre-tension force increases.

An advantageous arrangement for translating the actuating movement of the pawl actuation lever 5 into the deflection movement of the deflection lever 7 with desirable variability based on rapidity is realized by having deflection lever 7 be configured to pivot around a pivoting axis 13 and by having the center of mass of the deflection lever 7 be displaced from the pivoting axis 13. In that case, the rotation of the deflection lever 7 around the pivoting axis 13, which is an axis in the geometrical sense, will have the desired dependence on velocity.

Further, it is preferred that the pawl actuation lever 5 is configured to pivot around an actuation lever axis 11 and the deflection lever 7 pivotably coupled to the pawl actuation lever 5. In such an arrangement, which is shown in FIGS. 1 to 3, it is also preferred that the engagement spring 12*a* exerts the engagement pre-tension force on the actuation lever axis 11. In other words, one end of the engagement spring 12 is supported by the actuation lever axis 11 and the other end exerts its force on the deflection lever 7.

It has proven particularly useful and is also shown in FIGS. 1 to 3 that the deflection lever 7 is configured to pivot around a deflection lever axis 13*a* of the pawl actuation lever 5. Thereby the rotating movement of the pawl actuation lever 5—caused by its actuation—is translated into a combined linear and circular motion of the deflection lever 7 in its deflection movement. When such a deflection lever axis 13*a* is provided, it is further preferred that the engagement spring 12*a* is a leg spring 12*b* arranged around the deflection lever axis 13*a*. This can also be seen in FIGS. 1 to 3.

In order to ensure that the pawl actuation lever 5 is resting such that the deflection lever 7 has a defined starting point for its deflection movement, it is also preferred that the engagement arrangement 6 comprises a return spring arrangement 14 which is configured to exert a return force on the pawl actuation lever 5. Preferably, this return force is exerted on a return protrusion 20 of the pawl actuation lever 5 in a direction opposite to the deflection movement, i.e. in a direction which counteracts the deflection movement. Such a return protrusion 20 may be any structure coupled or arranged on the pawl actuation lever 5 which is suitable to be engaged by the return spring arrangement 14. A possible embodiment of such a return protrusion 20 is illustrated in FIGS. 1 to 3.

For such a return spring arrangement 14, a preferred embodiment has the return spring arrangement 14 comprise a return spring 14*a* which is a leg spring arranged around the actuation lever axis 11.

To further adjust the characteristic behavior of the deflection lever 7 on its deflection movement, in which it may take a free-wheeling path or an engagement path, it is preferred that a free-wheeling pre-tension force towards a free-wheeling path is exerted on the deflection lever 7. By having such a free-wheeling pre-tension force acting on the deflection lever 7 to move towards the free-wheeling path, it is no longer necessary to rely solely on the inertial mass of the deflection lever 7 or on the circular motion of the deflection lever 7 to achieve this effect. Preferably, such a free-wheeling pre-tension force towards a free-wheeling path is exerted by free-wheeling spring arrangement 15.

Another advantageous benefit of such a free-wheeling spring arrangement 15 is that variations in the starting position of the pawl actuation lever 5, which in turn result in different lengths of the deflection movement, may be compensated by the free-wheeling spring arrangement 15. Independent of possible tolerances in the starting position of the door handle, especially however, independent of possible tolerances in the length of the Bowden cable between the door handle and the pawl actuation lever 5, the deflection lever 7 is being spring biased into a defined starting position (pivot position with respect to the deflection lever axis 13*a*) by the free-wheeling spring arrangement 15.

Further, it is desirable that this free-wheeling pre-tension force has a smaller effect when the deflection lever 7 moves slowly in its deflection movement than when it moves rapidly. Therefore, it can be advantageous to have the deflection lever 7 be coupled to a peg structure 16 and have the free-wheeling spring arrangement 15 comprise a free-wheeling spring 15*a* which is configured to engage the peg structure 16 to exert the free-wheeling pre-tension force. Such a peg structure 16 may be any protrusion or element via which the free-wheeling spring 15*a* may exert force on the deflection lever 7. In the embodiment of FIGS. 1 to 3, that peg structure is arranged on the reverse side of the deflection lever 7.

Preferably, the deflection movement of the deflection lever 7 causes a relative movement between the free-wheeling spring 15*a* and the peg structure 16. This relative movement may then be used to modify the free-wheeling pre-tension force depending on the properties of this relative movement.

For example, in the preferred embodiment which is also disclosed in FIGS. 1 to 3, the free-wheeling spring 15*a* is a leg spring and the relative movement between the free-wheeling spring 15*a* and the peg structure 16 causes a contact point between the peg structure 16 and a leg of the free-wheeling spring 15*a* to move up the leg, thereby reducing the free-wheeling pre-tension force.

This has the effect that when the deflection lever 7 moves slowly, the free-wheeling spring has more time to relax. Thus, the free-wheeling pre-tension force is reduced, thereby making it less likely that the deflection lever 7 moves along a free-wheeling path and making it more likely that the deflection lever 7 moves along an engagement path.

Further, in a preferred embodiment, the deflection movement of the deflection lever 7 causes a disengagement of the free-wheeling spring 15*a* from the peg structure 16 after deflection movement has reached a disengagement distance. Such an arrangement also acts to have a stronger effect towards the free-wheeling path on a fast movement of the deflection lever 7 and a smaller such effect on a slower movement of the deflection lever 7.

Preferably, this is achieved by having the engagement arrangement 6 comprise a blocking projection 17 configured to disengage the free-wheeling spring 15*a* from the peg structure 16 after the deflection movement has reached the disengagement distance. Thus, the blocking projection 17 blocks further movement of the respective leg of the free-wheeling spring 15*a*, thereby decoupling it from the deflection lever 7.

Finally it may be economical to employ this mechanism described not only for crash safety, but also for implementing a "locked" or "unlocked" state during normal operation of the motor vehicle lock. Therefore it is preferred that a lock mechanism is provided which may be brought into different functional states such as "unlocked" and "locked" via a lock actuation arrangement and wherein the lock mechanism acts on the deflection lever 7 for realizing the functional states "unlocked" and "locked" such that in the functional state "unlocked" the lock mechanism causes a deflection movement along the free-wheeling path and in the functional state "locked" the lock mechanism causes a deflection movement along the engagement path. To this end it may be advantageous that a locking lever 18 of the lock mechanism engages a lock contour 19 of the deflection lever 7 for causing a deflection movement along the free-wheeling path. This locking lever 18 and the lock contour 19 are also disclosed in FIGS. 1 to 3. It is preferred that the lock contour 19 is arranged at the same end of the deflection lever 7 as the corner profile 10.

Figure 4:
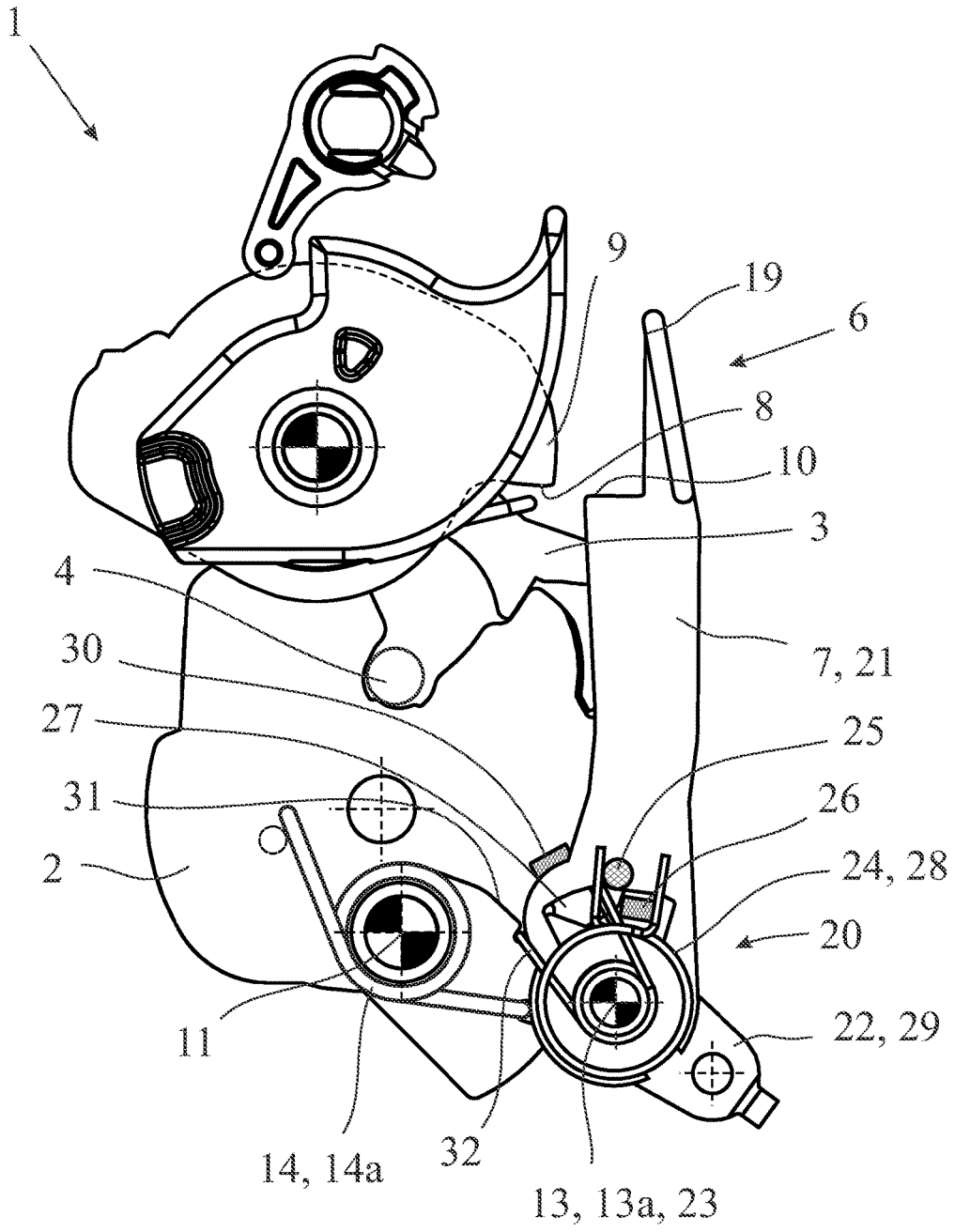
FIG. 4 the relevant parts of a proposed motor vehicle lock according to a further embodiment when a pawl actuation lever is not actuated, FIG. 5 the proposed motor vehicle lock of FIG. 4 after the pawl actuation lever has been actuated and the deflection lever has moved along a free-wheeling path and FIG. 6 the proposed motor vehicle lock of FIG. 4 after the pawl actuation lever has been actuated and the deflection lever has moved on an engagement path.
Figure 5:
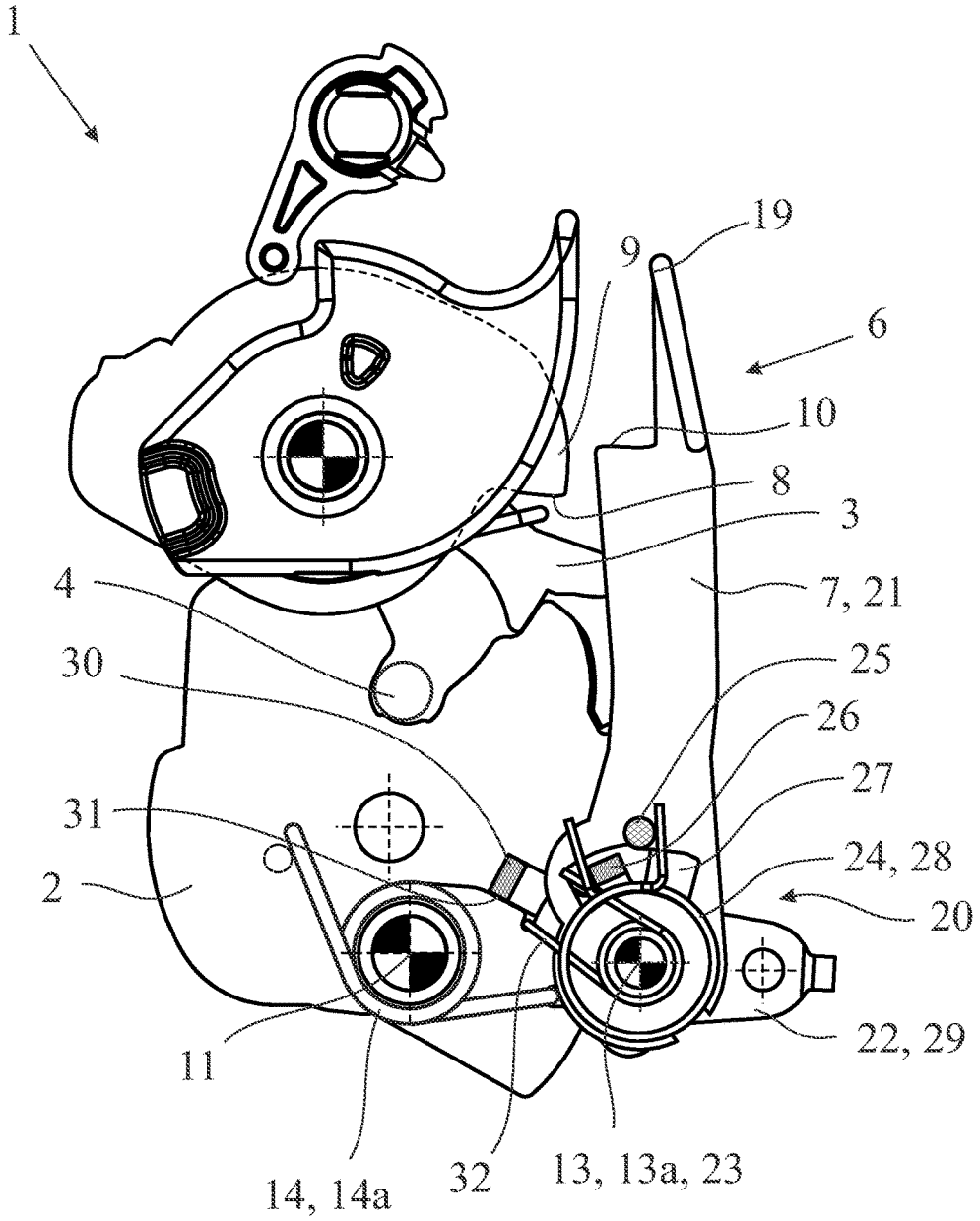
Figure 6:
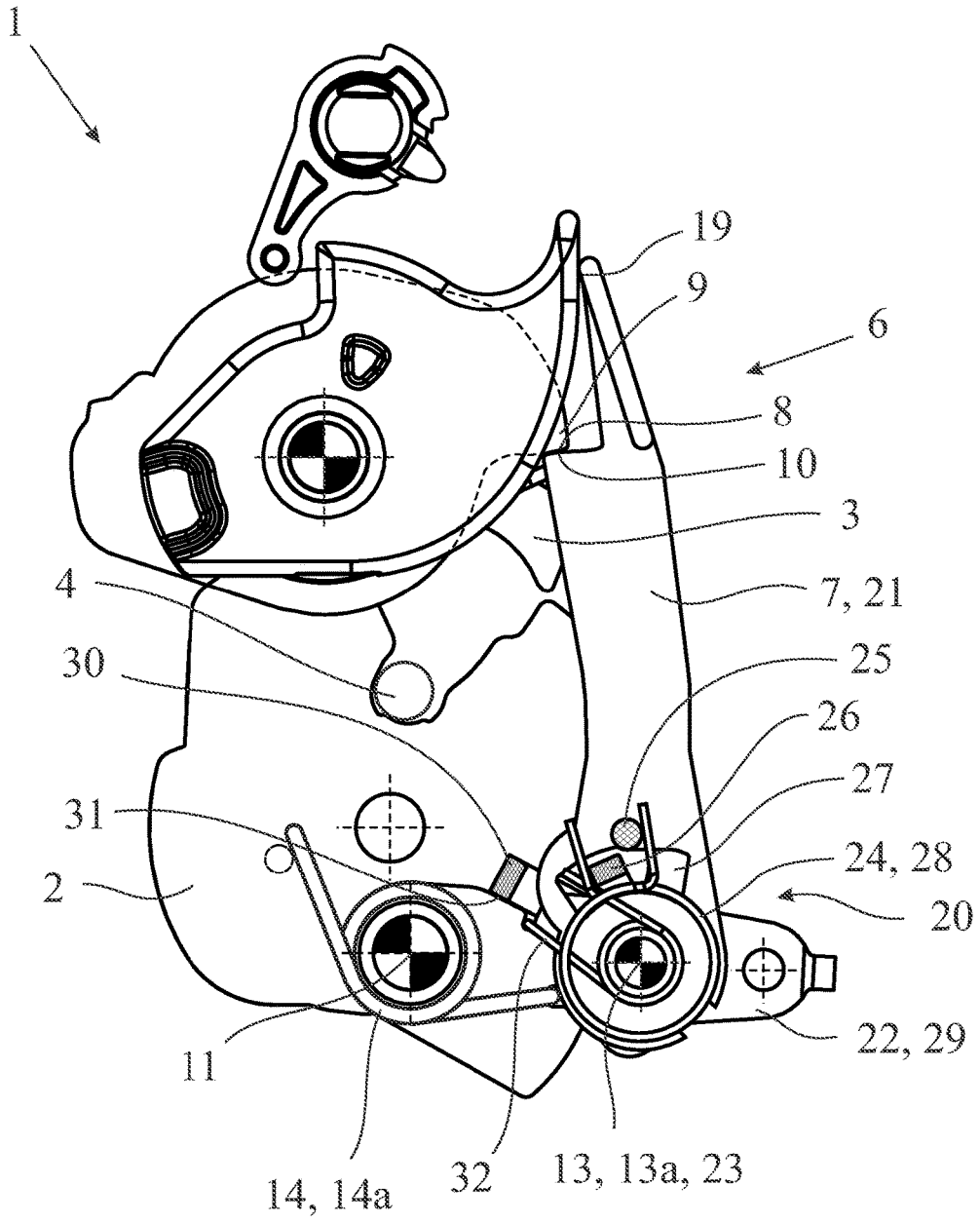

FIGS. 4 to 6 present a further embodiment of the proposed motor vehicle lock 1. The situations illustrated in FIGS. 4 to 6 correspond to those of FIGS. 1 to 3, in particular as regards the state of actuation of the pawl actuation lever 5 and the movement of the deflection lever 7 along a free-wheeling path or along an engagement path.

In describing the further embodiment of the proposed motor vehicle lock 1, like reference numerals will be used for like elements of the first embodiment of the proposed motor vehicle lock 1. Likewise, the following description will specify the differences of the further embodiment to the embodiment of FIGS. 1 to 3, with all other aspects of the further embodiment, in particular the fundamental mode of operation of the engagement operation, being understood to be identical to those of the embodiment of FIGS. 1 to 3. One difference is that, though the further embodiment also comprises a pawl actuation lever 5, that pawl actuation lever 5 is not directly coupled to an outer door handle. The way that the pawl actuation lever 5 is actuated in the further embodiment will be described further below.

The further embodiment of the proposed motor vehicle lock 1 aims to obviate the need for pre-tensioning the deflection lever 7, from which advantages result that will be detailed further in the following. In the further embodiment of the proposed motor vehicle lock 1, the engagement arrangement 6 comprises a flection structure 20 with a pair of arms 21,22 comprising a first arm 21 and a second arm 22. The pair of arms 21, 22 is coupled pivotably around a flection axis 23. The flection structure 20 is further configured to exert an internal torque on the pair of arms 21, 22 against a pivoting of the pair of arms from an angled neutral position in at least one pivoting direction.

In other words, the first arm 21 and the second arm 22 may be pivoted relative to each other. However, the flection structure 20 is such that, when the pair of arms 21, 22 is in a certain neutral position, a torque created internally by the flection structure 20 resists such a pivoting, at least in one direction. One example for this mechanism may for example be a pair of arms 21, 22 pressed against each other with friction. In this case, relative pivoting from the starting position, which may be understood to be the neutral position, has to overcome the torque caused by friction. The neutral position is angled in the sense that first arm 21 and the second arm 22 do not form a straight line in the neutral position but are set at an angle.

It is also possible that the neutral position is not restricted to a particular, single relative angle of the pair of arms 21, 22, but comprises a range of relative angles of the pair of arms 21, 22.

The effect just described can be used for making the deflection lever 7 move along the free-wheeling path or along the engagement path depending on the rapidity of the actuation movement. For this, preferably the flection structure 20 is configured such that when the actuation movement surpasses the rapidity threshold, the inertial characteristic of the deflection lever 7 causes the pair of arms 21, 22 to pivot by overcoming the internal torque, thereby resulting in a deflection movement along the free-wheeling path.

Likewise, it is preferred that the flection structure 20 is configured such that when the actuation movement is below the rapidity threshold, the internal torque keeps the pair of arms 21, 22 in the neutral position, thereby resulting in a deflection movement along the engagement path.

Thus principally the internal torque has to be overcome to cause a deflection movement along the free-wheeling path. No external pre-tension on the pair of arms 21, 22 in the neutral position is necessary, because the internal torque only arises when an external pivoting torque is applied.

It is further preferred that the flection structure 20 is configured to exert an internal torque on the pair of arms 21, 22 towards the neutral position when the pair of arms 21, 22 is at a position different from the neutral position in at least one pivoting direction. Preferably, the internal torque is exerted for any one pivoting direction. Thereby, the flection structure 20 also acts to force the pair of arms 21, 22 back into the neutral position after a deviation from the neutral position. This can be achieved, for example, by having an L-shaped, single piece element from an elastic material. Both arms of the L-shaped element may be pivoted relative to each other in either direction, but the internal torque will force them back into the L-shape in the absence of external forces.

In the preferred embodiment of FIGS. 4 to 6, the first arm 21 and the second arm 22 are formed as separate elements, wherein the flection structure 20 comprises a spring coupling 24 configured to exert the internal torque on the pair of arms 21, 22. Thus, the flection structure 20 here comprises three elements, namely the pair of arms 21, 22 and the spring coupling 24, and the torque is internal with regard to the flection structure 20 as a whole, not with regard to any single component of the flection structure 20.

As a preferred way of internal engagement of such a flection structure 20, it is preferred that the pair of arms 21, 22 comprises a pair of spring pegs 25, 26 configured to engage the spring coupling 24, wherein the pair of arms 21, 22 also comprises an opening 27 for receiving a first spring peg 24 of the pair of spring pegs 25, 26. It is to be pointed out here that each arm 21, 22 need not consist of only a single elongate member, but may comprise several elongations in different directions, as demonstrated by the position of the second spring peg 26 in the further embodiment of FIGS. 4 to 6. Such an arrangement permits having the pair of arms 21, 22 engage the spring coupling 24 in close proximity.

This is particularly advantageous when, as is depicted in FIGS. 4 to 6, the spring coupling 24 comprises an omega spring 28, which omega spring 28 is substantially tension-free at the neutral position. This ensures that, in the neutral state, there is no internal torque in the flection structure 20, on the one hand, and that a pivoting of the pair of arms 21, 22 in either direction results in internal torque on the pair of arms 21, 22 caused by the omega spring 28. The close arrangement of the pair of spring pegs 25, 26 further suits conveniently with the substantially parallel alignment of the legs of the omega spring 28 in the neutral state, as seen in FIG. 4. It is also preferred that the omega spring 28 is arranged around the flection axis 23, which in the present embodiment is identical to the pivoting axis 13 and the deflection lever axis 13*a*.

Preferably and according to the further embodiment, the first arm 21 is the deflection lever 7. Likewise it is preferred and also implemented in the further embodiment that the second arm 22 is a door handle lever 29. In the same way as the pawl actuation lever 5 of the embodiment of FIGS. 1 to 3, the door handle lever 29 of this embodiment is coupled to the outer door handle.

Here, the door handle lever 29 is preferably used for an indirect actuation of the pawl actuation lever 5 in the following manner. The door handle lever 29 is pivotably arranged, preferably around the flection axis 23, and configured to engage the pawl actuation lever 5 on reaching an engagement pivoting position, thereby causing the actuation movement of the pawl actuation lever 5. To this end, the door handle lever 29 comprises a door handle protrusion 30, which engages a corresponding stop surface 31 of the pawl actuation lever 5 once the door handle lever 29 has pivoted sufficiently, that pivoting position being said engagement pivoting position.

The further embodiment also comprises a rest spring 32 engaging both the pawl actuation lever 5 and the door handle lever 29 via the second spring peg 26, which ensures a defined relative position between the door handle lever 29 and the pawl actuation lever 5 in the state prior to actuation of the door handle lever 29, i.e. prior to the actuation of the outer door handle.

Having now described the elements of the further embodiment of FIGS. 4 to 6, its mode of operation will now be briefly summarized in the following:

Starting from the situation of FIG. 4, when the outer door handle is actuated—either by manual operation or because of a crash situation—the door handle lever 29 is pivoted in an anti-clockwise direction, against the torque of the rest spring 32 applied to the second spring peg 26, around the flection axis 23. This causes the second spring peg 26 to disengage one leg of the omega spring 28 and then engage the other leg of the omega spring 28. Once the other leg of the omega spring 28 is engaged, a further pivoting of the door handle lever 29 causes a like pivoting of the omega spring 28 until the leg originally engaging the second spring peg 26 engages the first spring peg 25. From this point on, a further pivoting of the door handle lever 29 causes the omega spring 28 to compress and, consequently, exert a torque on the first arm 21—corresponding to the deflection lever 7—toward a pivoting in the counter-clockwise direction, i.e. toward the engagement path. However, this torque needs to overcome the rotational inertia of the deflection lever 7.

Parallel to this mechanism, the door handle lever 29 engages the pawl actuation lever 5 when the door handle protrusion 30 engages the stop surface 31. Any further pivoting of the door handle lever 29 then directly translates into an actuation movement of the actuation lever 5. Since the actuation lever 5 is coupled to the deflection lever 7 at the deflection lever axis 13*a*, the actuation movement of the actuation lever 5 causes the deflection movement of the deflection lever 7.

Depending now on the rapidity of the pivoting of the door handle lever 29, which directly translates to the rapidity of the actuation movement of the pawl actuation lever 5 once the door handle protrusion 30 engages the stop surface 31, either the torque applied to the deflection lever 7 by the omega spring 28 has enough time to pivot the deflection lever 7 against its rotational inertia on the engagement path, thereby resulting in the situation of FIG. 6, or the actuation movement of the pawl actuation lever 5 is sufficiently rapid to move the deflection lever 7 on the free-wheeling path before the omega spring 28 can move the deflection lever 7 to the engagement path, with the situation of FIG. 5 being the result.

One advantage of the further embodiment is that friction, e.g. the friction between the free-wheeling spring 15*a* and the peg structure 16 of the embodiment of FIGS. 1 to 3 during the deflection movement, is avoided.

It is preferred that the pair of arms 21, 22 is in a neutral position after completion of the deflection movement along the engagement path and engaging the counter contour 8. It is also preferred that the pair of arms 21, 22 is in a neutral position in a rest state of the engagement arrangement prior to a deflection movement of the deflection lever 7. This corresponds to the situation of FIG. 4.

By having the pair of arms 21, 22 be in the neutral position for the regular, i.e. non-crash situation, case of actuating the outer door handle, that actuation will not have to work against any force or torque from spring coupling 24 of the flection arrangement 20. This is in contrast to the embodiment of FIGS. 1 to 3, in which any deflection movement of the deflection lever 7 works against the engagement spring 12. Thus, the energy required for the actuation movement is reduced in the further embodiment.

Finally it may be pointed out that the proposed solution is not only applicable to a motor vehicle lock 1 that is actuated manually by actuating a door handle. In the case that the pawl actuation lever 5 is drivable by a motor drive, a crash induced actuation of the pawl actuation lever 5 with high rapidity accordingly leads to the pawl actuation lever 5 running free as noted above.

The invention claimed is:

1. A motor vehicle lock for a motor vehicle door arrangement, comprising:

a catch and a pawl, which is assigned to the catch, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein the pawl may be deflected into a release position, in which it releases the catch;

a pawl actuation lever for deflecting the pawl into the release position; and an engagement arrangement between the pawl actuation lever and the pawl, wherein the engagement arrangement comprises a deflection lever on the side of the pawl actuation lever and a counter contour on the side of the pawl, wherein the deflection lever is configured to engage the counter contour, thereby deflecting the pawl into the release position, wherein an actuation movement of the pawl actuation lever for deflecting the pawl into the release position is translated into a deflection movement of the deflection lever, wherein an inertial characteristic of the deflection lever causes a deflection movement along a free-wheeling path, in which free-wheeling path the deflection lever misses the counter contour, when the actuation movement surpasses a rapidity threshold, and causes a deflection movement along an engagement path, in which engagement path the deflection lever engages the counter contour, when the actuation movement is below the rapidity threshold;

a peg structure coupled to the deflection lever;

a free-wheeling spring arrangement comprising a free-wheeling spring configured to engage the peg structure to exert a free-wheeling pre-tension force on the deflection lever towards the free-wheeling path; and an engagement spring configured to exert an engagement pre-tension force on the deflection lever towards the engagement path.

2. The motor vehicle lock according to claim 1, wherein the counter contour is arranged on a contour plate which is coupled torque-proof to the pawl and/or wherein the deflection lever comprises a corner profile for engaging the counter contour.

3. The motor vehicle lock according to claim 1, wherein the deflection movement comprises a circular movement and the deflection movement along the free-wheeling path is caused by a centrifugal force acting on the deflection lever.

4. The motor vehicle lock according to claim 1, wherein, the inertial characteristic of the deflection lever comprises the inertial mass and/or the center of mass, which inertial characteristic is configured such that it causes a deflection movement along the free-wheeling path through the centrifugal force acting on the deflection lever when the actuation movement surpasses a predetermined rapidity threshold.

5. The motor vehicle lock according to claim 1, wherein the engagement spring is arranged such that the engagement pre-tension force increases with the deflection movement of the deflection lever.

6. The motor vehicle lock according to claim 1, wherein the deflection lever is configured to pivot around a pivoting axis and the center of mass of the deflection lever is displaced from the pivoting axis.

7. The motor vehicle lock according to claim 6, wherein the pivoting axis is a deflection lever axis of the pawl actuation lever.

8. The motor vehicle lock according to claim 6, wherein the pawl actuation lever is configured to pivot around an actuation lever axis and the deflection lever is pivotably coupled to the pawl actuation lever, wherein the engagement spring exerts the engagement pre-tension force on the actuation lever axis.

9. The motor vehicle lock according to claim 1, wherein the engagement arrangement comprises a return spring arrangement configured to exert a return force on the pawl actuation lever.

10. The motor vehicle lock according to claim 9, wherein the return spring arrangement comprises a return spring which is a leg spring arranged around the actuation lever axis.

11. The motor vehicle lock according to claim 9, wherein the return spring arrangement is configured to exert a return force on the pawl actuation lever on a return protrusion of the pawl actuation lever, in a direction opposite to the deflection movement.

12. The motor vehicle lock according to claim 1, wherein a lock mechanism is provided, which may be brought into different functional states such as "unlocked" and "locked" via a lock actuation arrangement and wherein the lock mechanism acts on the deflection lever for realizing the functional states "unlocked" and "locked" such that in the functional state "unlocked" the lock mechanism causes a deflection movement along the free-wheeling path and in the functional state "locked" the lock mechanism causes a deflection movement along the engagement path.

13. The motor vehicle lock according to claim 12, wherein the engagement arrangement comprises a blocking projection configured to disengage the free-wheeling spring from the peg structure after the deflection movement has reached the disengagement distance.

14. The motor vehicle lock according to claim 12, wherein a locking lever of the lock mechanism engages a lock contour of the deflection lever for causing a deflection movement along the free-wheeling path, in particular, wherein the lock contour is arranged at a same end of the deflection lever as the corner profile.

15. The vehicle lock according to one of claim 1, characterized in that the engagement arrangement comprises a flection structure with a pair of arms comprising a first arm and a second arm, wherein the pair of arms is coupled pivotably around a flection axis and wherein the flection structure is configured to exert an internal torque on the pair of arms against a pivoting of the pair of arms from an angled neutral position in at least one pivoting direction.

16. Motor vehicle lock according to claim 15, wherein the first arm is the deflection lever.

17. Motor vehicle lock according to claim 15, wherein the second arm is a door handle lever.

* * * * *